US005239304A

United States Patent [19]

Egashira

[11] Patent Number: 5,239,304

[45] Date of Patent: Aug. 24, 1993

[54] THREE-WAVE ANTENNA FOR VEHICLES

[75] Inventor: Yoshimi Egashira, Sagamihara, Japan

[73] Assignee: Harada Kogyo Kabushiki Kaisha, Tokyo, Japan

[21] Appl. No.: 526,683

[22] Filed: May 21, 1990

Related U.S. Application Data

[63] Continuation of Ser. No. 128,695, Dec. 4, 1987, abandoned.

[30] Foreign Application Priority Data

Jan. 5, 1987 [JP] Japan ..... 62-175[U]

[51] Int. Cl.[5] ..... H01Q 21/00

[52] U.S. Cl. ..... 343/727; 343/715; 343/903

[58] Field of Search ..... 343/727, 715, 790, 791, 343/792, 729, 730, 900, 901

[56] References Cited

U.S. PATENT DOCUMENTS

| | | | |
|---|---|---|---|
| 3,899,787 | 8/1975 | Czerwinski | 343/790 |
| 4,095,229 | 6/1978 | Elliot | 343/715 |
| 4,413,304 | 11/1983 | Gerry | 343/851 |
| 4,675,687 | 6/1987 | Elliot | 343/715 |
| 4,721,965 | 1/1988 | Elliot | 343/715 |
| 4,734,703 | 3/1988 | Nakase et al. | 343/715 |
| 4,755,820 | 7/1988 | Backhouse et al. | 343/753 |

FOREIGN PATENT DOCUMENTS

| | | | |
|---|---|---|---|
| 2636523 | 2/1978 | Fed. Rep. of Germany | 343/790 |

*Primary Examiner*—Rolf Hille
*Assistant Examiner*—Hoanganh Le
*Attorney, Agent, or Firm*—Koda and Androlia

[57] ABSTRACT

A three-wave vehicle antenna in which an insulating pipe is connected to the tip of a conducting pipe, and an MT wave antenna element and a coaxial MT wave matching device are housed in the insulating pipe. One end of the coaxial MT wave feeder cable is connected to the matching device and the other end is guided through the conductive pipe which is designed to be used as an AM/FM antenna. The coaxial MT wave feeder cable uses polytetrafluoroethylene, at least for the external insulation member, for covering the outer conductor. With this arrangement it is possible for the three-wave vehicle antenna to check decreases in sensitivity of the AM/FM wave antenna element, since it is feasible to lower the stray capacity between the conductive pipe and the outer conductor of the coaxial MT wave feeder cable without enlarging the diameter of the conductor pipe.

1 Claim, 3 Drawing Sheets

THREE-WAVE ANTENNA FOR VEHICLES

This is a continuation of application Ser. No. 128,695, filed Dec. 4, 1987, now abandoned.

BACKGROUND OF THE INVENTION

1. Field of the Invention

The present invention relates to a three-wave antenna for vehicles used for transmitting and receiving three types of waves including transmit-receive waves for car telephone (hereafter abbreviated as "MT waves"), amplitude modulation broadcast waves (hereafter abbreviated as "AM waves"), and frequency modulation broadcast waves (hereafter abbreviated as "FM waves").

2. Prior Art

Conventional vehicle antennas are mainly used for receiving AM/FM waves. Therefore, a single unit sharing a two-wave (AM/FM) antenna is designed to receive these two types of waves. Over recent years, however, the widespread use of vehicle telephones has made it increasingly necessary to install antennas which transmit and receive MT waves. An MT wave (usually, ultra short waves) is far different from AM/FM waves in frequency band and also in radiation characteristics. Accordingly, MT wave antennas have conventionally been installed separately.

When an MT wave antenna is installed separately from the AM/FM wave antenna, it has the following disadvantages. Firstly, from an aesthetic standpoint the appearance of vehicle is adversely effected. In addition, other disadvantages include the high manufacturing cost of such antennas and complex work required for installation. Accordingly, there is a simple solution to such problems and that is to combine the MT wave antenna into a single unit with the AM/FM wave antenna.

To this end, the inventors of the present invention have invented a three-wave vehicle antenna in which an insulating pipe is connected to an end of a conductive pipe; an MT wave antenna element and a matching coaxial MT wave device are housed in the insulating pipe; one end of a coaxial feeder cable, with its other end connected to the matching device, is led into the body of the automobile through the conductive pipe; and the pipe is used as an AM/FM antenna element.

In the above-described three-wave vehicle antenna, the antenna is unified and the foregoing problems are solved. However, other problems still remain. The coaxial MT wave feeder cable passes through the inside of the conductive pipe as the AM/FM antenna element. Accordingly, due to the stray capacity present between the outer conductor (braided shielding wire) composing the feeder cable and the conductive pipe, the sensitivity of the AM/FM antenna is lowered. In order to prevent such a decrease in sensitivity, the gap between the inner circumferential surface of the conductive pipe and the outer circumferential surface of the feeder cable must be widened. However, when this is done the conductive pipe becomes larger in diameter, thus making the whole body of the antenna larger in size.

Accordingly, the object of the present invention is to provide a three-wave vehicle antenna which reduces the stray capacity between the conductive pipe and the coaxial MT wave feeder cable, without causing the conductive pipe to be increased in diameter and is thus capable of preventing the sensitivity of the AM/FM wave antenna from being lowered.

The above object is achieved via a unique structure for an antenna wherein the antenna is constructed such that an insulating pipe is connected to the tip of a conductive pipe, with a MT wave antenna element and a coaxial MT wave matching device housed in the insulating pipe. One end of the coaxial MT wave feeder cable is connected to the matching device which is led into the body of the automobile through the conductive pipe which is used as the AM/FM wave antenna element and as the insulating members for the coaxial MT wave feeder cable. Polytetrafluoroethylene is used at least for the external insulation member covering the outer conductor.

With the above described structure the following effects result: because polytetrafluoroethylene is as low in specific inductive capacity as 2.07, even if the gap between the inner circumferential surface of the conductive pipe and the outer circumferential surface of the feeder cable is the same as in conventional cases, the stray capacity between the conductive pipe and the feeder cable becomes considerably lower in comparison to that of conventional cases. Also, polytetrafluoroethylene is excellent in heat resistance, blockage resistance, chemical resistance, buckling resistance, etc. and in addition it has the characteristic of being noticeably low in surface friction resistance. Consequently, it provides the advantages including that, in the case when the feeder cable is moved with the telescopic movement of the antenna element, even if it comes into contact with the draining member, the damage due to friction does not occur making it possible for the feeder cable to be used stabily for long time.

DETAILED DESCRIPTION OF THE INVENTION

Figure 1:
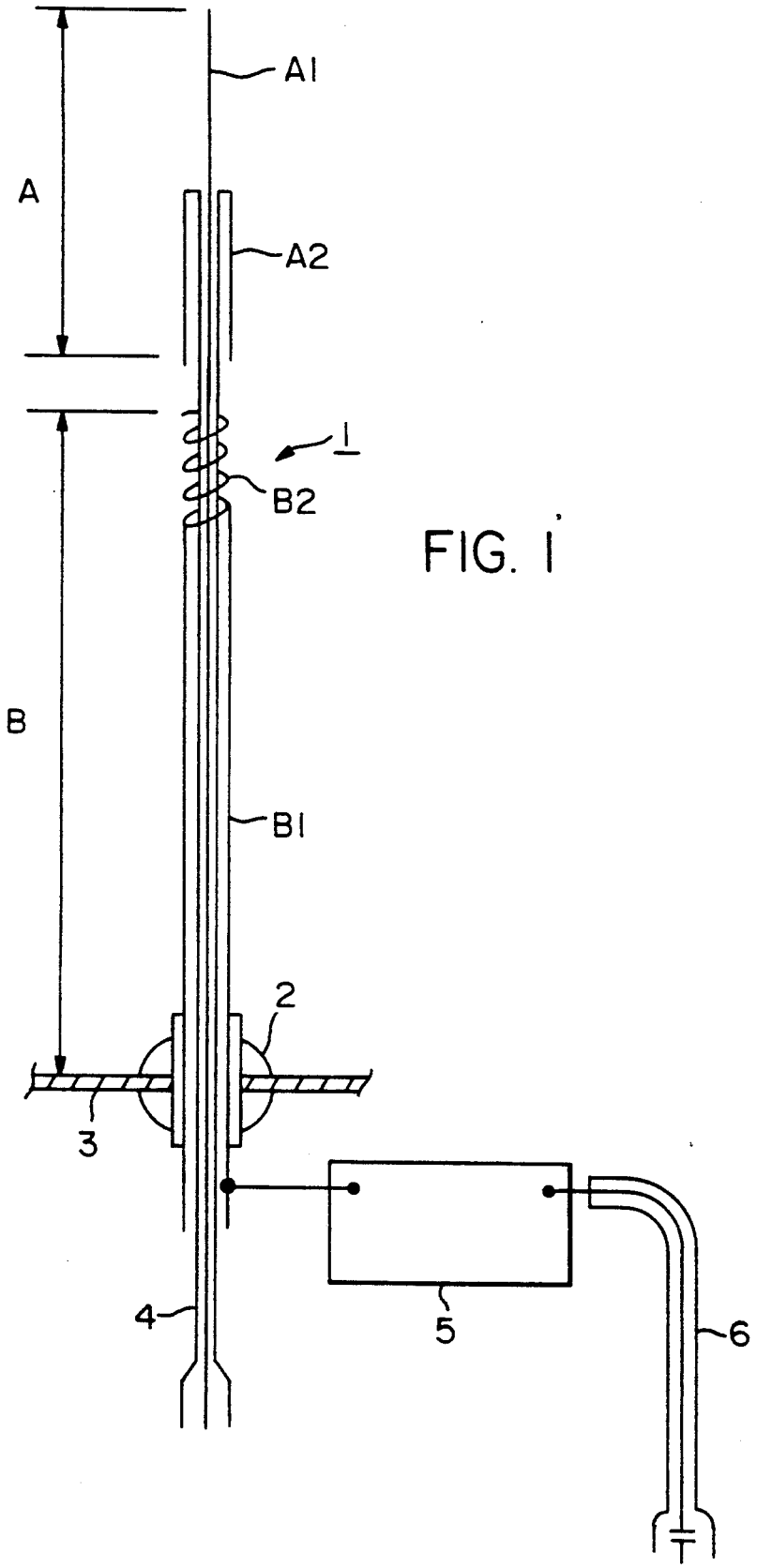
FIG. 1 is a diagram showing an outline of an embodiment of this invention.

FIG. 1 is a diagram schematically showing an embodiment of the present invention. In FIG. 1, reference numeral 1 denotes a three-wave antenna section composed of an MT wave antenna subsection A which includes an MT wave antenna element A1 and a coaxial MT matching device A2 and an AM/FM wave antenna subsection B which includes a single conductive pipe B1 and a loading coil B2. This three-wave antenna section 1 is mounted to the body wall 3 of a vehicle body by a mounting assembly 2. Reference numeral 4 denotes a coaxial MT wave feeder cable connected to the MT wave antenna subsection A and an AM/FM wave matching amplifying device 5 is connected to the AM/FM wave antenna subsection B. A coaxial AM/FM wave feeder cable 6 is connected to the matching amplifying device 5. Also, in the foregoing antenna subsection B, a top loading coil B2 is installed.

Figure 2:
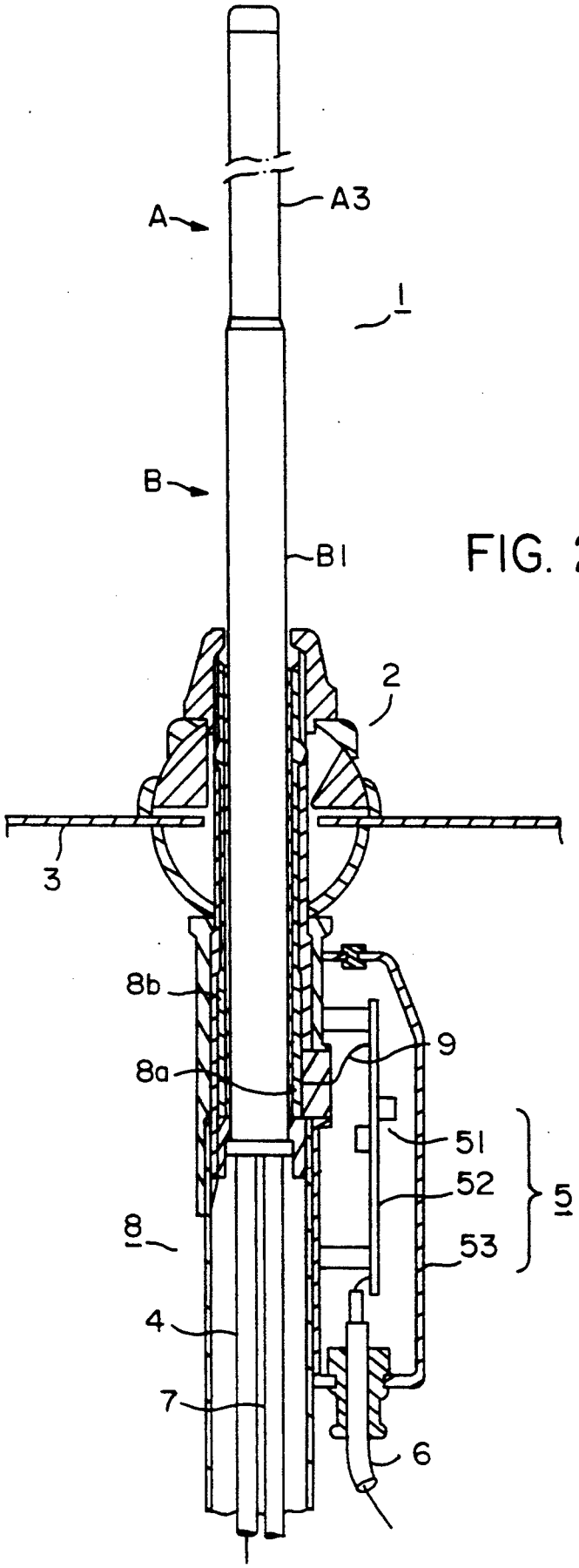
FIG. 2 is a sectional view showing a structure of the embodiment of FIG. 1 in a concrete manner.

FIG. 2 is a sectional view of the structure of the three-wave antenna shown in FIG. 1. Shown in FIG. 2, in the three-wave antenna section 1, is the MT wave antenna subsection A comprising an insulating pipe A3 housing therein the MT wave antenna element A1 and coaxial MT matching device A2 having a minor diameter which is inserted in an optionally slidable manner into the AM/FM wave antenna subsection B having a major diameter. The whole body of the three-wave antenna section 1 is housed in a housing cylinder 8 provided in the vehicle body such that the antenna moves, in and out of the cylinder via a telescopically driving cable 7. A major diameter cylinder formed of a conductive pipe B1 of the AM/FM wave antenna subsection B is electrically connected to a metal pipe **8*b* through a slidable contact 8*a*, and the metal pipe 8*b* is connected to the AM/FM wave matching amplifying device 5 through a lead wire 9. The AM/FM wave matching amplifying device 5 includes an electronic element 51 installed on a printed board 52 and is housed in a cover 53. DC power is supplied to the electronic part 51 on the printed board 52** from the vehicle's battery via a lead wire (not shown in the Figures).

Figure 3:
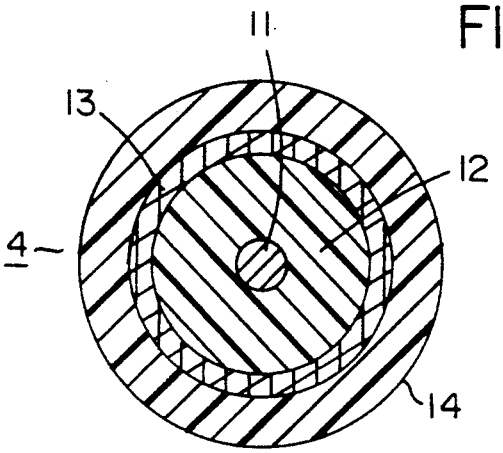
FIG. 3 is a sectional view of a coaxial MT wave feeder cable of the embodiment of FIG. 1.

FIG. 3 is a sectional view of the coaxial MT wave feeder cable 4. In the Figure, reference numeral 11 indicates a central conductor and the outer circumference of this central conductor 11 is covered with an internal insulation member 12 made of polyethylene. Along the outer circumference of the internal insulation member 12, an outer conductor (shielding braided wire) 13 is disposed coaxially with the central conductor 11. The outer circumference of the outer conductor 13 is covered with an external insulation member 14 made of polytetrafluoroethylene (Trade name Teflon manufactured by DuPont Corporation, hereunder referred to as Teflon). The external insulation member 14 is, because of the characteristics of the its material, as low as 2.07 in specific inductive capacity and is also outstanding in heat resistance, blockage resistance, chemical resistance, buckling resistance, compression resistance, etc. In addition, it has the desirable feature of being low in surface friction resistance.

The above described embodiment shows the following functional effects.

Figure 4:
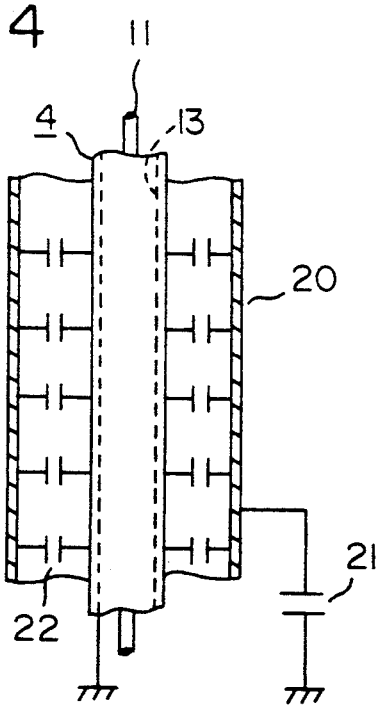
FIGS. 4 and 5 are diagrams illustrating the function of the embodiment of FIG. 1.

FIG. 4 is a diagram showing a state wherein the coaxial MT wave feeder cable 4 is inserted into the axial center area of a conductive pipe 20 of the AM/FM wave antenna subsection B. As shown in this Figure, an electrostatic capacity 21 which is effective for the AM/FM antenna is provided between the conductive pipe 20 and the ground and separate from it, a stray capacity 22 is provided which is present between the conductive pipe 20 and the outer conductor 13 of the feeder cable 4. This stray capacity 22 causes decreases in the sensitivity of the AM/FM wave antenna.

Figure 5:
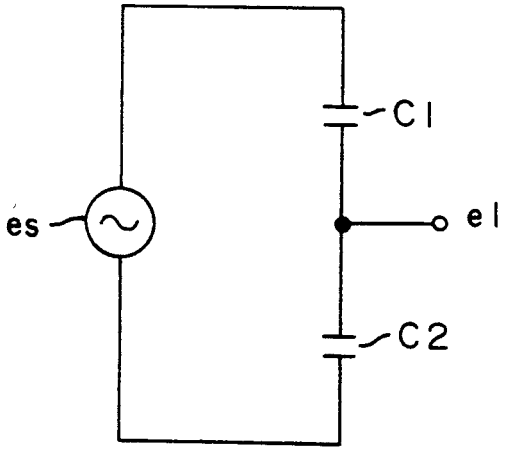

In other words, according to the equivalent circuit shown in FIG. 5, the sensitivity of the AM/FM wave antenna (capacitive antenna) can be represented by the equation shown below.

$$\frac{e1}{e_s} = 20 \log \frac{C1}{C1 + C2}$$

In the above equation, $e_s$ denotes a signal source, el denotes an output signal, C1 represents the capacity value of the electrostatic capacity 21, and C2 designates the capacity value of the stray capacity 22.

As shown above, as the capacitive value of the stray capacity 22 increases, the decrement of sensitivity also increases.

In conventional cases, vinyl chloride has been used for the external insulation member. Therefore, the capacitive value C2 was 100 PF or above and as a result, the decrement in sensitivity was great.

However, in the embodiment of the present invention, since Teflon (having a specific inductive capacity of 2.07) is used as the material for the external insulation member 14, the capacity valve C2 is about 50 to 60 PF, which is about half or less than half of the conventional capacitive value. Accordingly, the decrement in sensitivity becomes markedly small. Also, as mentioned previously, Teflon has other many outstanding characteristics which make it particularly suited for this use and therefore, it can be used stabily for a long period of time.

The present invention is not limited to the above described embodiment. For example, in the above embodiment only the external insulation member 14 is formed of Teflon, but the internal insulation member may also be formed of Teflon. Furthermore, in the embodiment the invention is applied to a telescopic three-wave antenna, but the invention may also be applied to a non-extendible three-wave antenna. In addition it goes without saying that various changes and modifications may be made to the present invention without departing from the spirit and scope thereof.

As seen from the above description, at least the external insulation member is formed of Teflon. As a result, it is possible to provide three-wave vehicle car antennas capable of reducing the stray capacity between the conductive pipe and the outer conductor of the coaxial MT wave feeder cable, thereby increasing the sensitivity of the AM/FM wave antenna, without increasing the diameter of the conductive pipe.

I claim:

1. A three-wave vehicle antenna including a single conductive pipe extending from a body of said vehicle, MT antenna sub-section comprising an MT wave antenna element and a coaxial MT wave matching device provided within an insulating pipe which is coupled to an extending end of said conducting pipe, a coaxial MT wave feeder cable, one end of said feeder cable being connected to said coaxial MT wave matching device and another end thereof being brought into said vehicle body through said conductive pipe, an AM/FM wave antenna subsection comprising said conductive pipe and a top loading coil coupled to only said extending end of said conductive pipe; and wherein polytetrafluoroethylene is used as an external insulation member for covering at least an outer conductor of said coaxial MT wave feeder cable.

* * * * *